US006228149B1

(12) United States Patent
Alenichev et al.

(10) Patent No.: US 6,228,149 B1
(45) Date of Patent: May 8, 2001

(54) METHOD AND APPARATUS FOR MOVING, FILTERING AND IONIZING AIR

(75) Inventors: Alexey Alenichev; Viktor Tkachenko; Viacheslav G. Karadgy, all of Moscow (RU)

(73) Assignee: Patterson Technique, Inc., Bythewood, SC (US)

( * ) Notice: Subject to any disclaimer, the term of this patent is extended or adjusted under 35 U.S.C. 154(b) by 0 days.

(21) Appl. No.: 09/233,460

(22) Filed: Jan. 20, 1999

(51) Int. Cl.[7] ..... B03C 3/40

(52) U.S. Cl. ..... 95/78; 55/DIG. 38; 96/62; 96/66; 96/97; 361/233; 417/49

(58) Field of Search ..... 96/97, 66, 62; 55/DIG. 38; 95/78; 417/49; 361/226, 233

(56) References Cited

U.S. PATENT DOCUMENTS

| | | | | |
|---|---|---|---|---|
| 895,729 | * | 8/1908 | Cottrell | 55/DIG. 38 |
| 2,559,526 | | 7/1951 | Van De Graaff et al. | 313/18 X |
| 2,593,869 | | 4/1952 | Fruth | 96/16 |
| 2,756,838 | | 7/1956 | Roberts | 96/18 |
| 2,778,443 | | 1/1957 | Yereance | 96/16 |
| 3,431,455 | | 3/1969 | Beyer et al. | 315/11 |
| 3,452,923 | | 7/1969 | Lamont | 417/49 |
| 3,768,258 | * | 10/1973 | Smith et al. | 96/97 X |
| 3,798,879 | | 3/1974 | Schmidt-Burbach et al. | 55/523 X |
| 3,910,778 | | 10/1975 | Shahgholi et al. | 96/16 |
| 4,066,526 | * | 1/1978 | Yeh | 95/78 X |
| 4,244,710 | * | 1/1981 | Burger | 96/66 X |
| 4,339,782 | * | 7/1982 | Yu et al. | 96/62 |
| 4,449,159 | * | 5/1984 | Schwab et al. | 96/62 |
| 4,518,401 | | 5/1985 | Pontius et al. | 96/15 |
| 4,631,002 | | 12/1986 | Pierini | 417/49 |
| 4,687,417 | | 8/1987 | Amboss | 417/49 |
| 4,689,056 | * | 8/1987 | Noguchi et al. | 96/97 X |
| 4,888,520 | | 12/1989 | Okamoto | 313/292 |
| 4,955,991 | * | 9/1990 | Torok et al. | 96/97 X |
| 5,061,745 | | 10/1991 | Wittmann et al. | 524/139 |
| 5,086,024 | | 2/1992 | Crapo et al. | 502/117 |
| 5,100,434 | | 3/1992 | Sweeny | 528/481 X |
| 5,199,257 | | 4/1993 | Colletta et al. | 60/275 |
| 5,254,155 | * | 10/1993 | Mensi | 96/97 X |
| 5,463,268 | | 10/1995 | Schroeder | 313/293 |
| 5,824,137 | * | 10/1998 | Gutsch et al. | 96/97 X |
| 5,837,035 | * | 11/1998 | Braun et al. | 95/78 |

FOREIGN PATENT DOCUMENTS

| | | |
|---|---|---|
| 4003564 C2 | 10/1993 | (DE) . |
| 4400827 C1 | 4/1995 | (DE) . |
| 4410213 C1 | 8/1995 | (DE) . |
| 2229 177 | 9/1990 | (GB) . |
| WO 95/25597 | 2/1995 | (WO) . |

* cited by examiner

*Primary Examiner*—Richard L. Chiesa
(74) *Attorney, Agent, or Firm*—Sughrue, Mion, Zinn, Macpeak & Seas, PLLC

(57) ABSTRACT

A fan assembly includes a tubular housing and electrodes which ionize air and cause the air to be filtered and to move through the tubular housing without use of moving parts, such as an impeller, thereby providing air filtration and ventilation without generation of vibrations and acoustic disturbances. An electric potential is applied between a longitudinally-oriented needle electrode and a planar or curved transversely-oriented net electrode disposed within the housing downstream of the needle electrode, thereby forming a longitudinally asymmetric electric field that ionizes and accelerates air molecules toward the net electrode, carrying the air molecules past the net electrode and through the air outlet. The assembly further includes a tubular duct electrode disposed within the housing on the outlet side ofthe net electrode, which collects ionized particles precipitated from the air. A conducting pivot, which is electrically connected to the net electrode, extends coaxially with the tubular duct electrode along at least a portion of the tubular duct electrode in the longitudinal direction and facilitates precipitation of the particles. The duct electrode can be removed and cleaned or replaced.

37 Claims, 1 Drawing Sheet

METHOD AND APPARATUS FOR MOVING, FILTERING AND IONIZING AIR

BACKGROUND OF THE INVENTION

1. Field of the Invention

The present invention relates to a method and apparatus for moving, filtering and ionizing air. More particularly, the present invention relates to a fan assembly having a tubular housing and electrodes which ionize air and cause the air to be filtered and to move through the tubular housing without use of moving parts, such as an impeller, thereby providing air filtration and ventilation without generation of vibrations and acoustic disturbances.

2. Description of the Related Art

Conventional fans, ventilation systems and air filtration systems presently used in industrial, commercial and residential applications typically employ an impeller or the like to generate an air flow. The rotary movement of the impeller in such systems causes acoustic disturbances and vibrations, the noise level of which may be excessive for a particular application. For example, it may be desirable to generate a virtually noiseless air flow for industrial applications such as cooling of personnel or equipment, exhausting and/or filtering of air, drying processes, and clean room applications. Noiseless air filtration may also be desirable in residential ventilation and filtration systems. Conventional impeller-based devices are incapable of providing air movement without generating significant noise. Accordingly, there is a need for a system capable of providing noisefree air flow and/or air filtration.

Electric fields have been used in a variety of technologies to ionize molecules or to generate a stream of electrons. For example, electrostatic precipitators conventionally use an electrostatic charge to remove particles from an air stream by attracting electrostatically charged particles to an oppositely charged collector. The system disclosed in U.S. Pat. No. 4,518,401 to Pontius et al. is representative of such systems. Specifically, Pontius et al. disclose an electrostatic precipitator comprising a plurality of positively-charged, longitudinally-extending vertical plates and a plurality of negatively-charged, vertically-extending rods interspaced between the plates. As air flows through the precipitator, the electric field formed between the rods and plates causes a corona discharge from the rods which negatively charges particles in the air, which are then drawn to the positively-charged plates and removed from the air. The plates are mechanically rapped periodically, causing the particles to fall into collection hoppers.

Other patents disclosing electrostatic precipitators include: U.S. Pat. No. 2,593,869 to Fruth; U.S. Pat. No. 2,756,838 to Roberts; U.S. Pat. No. 2,778,443 to Yereance; U.S. Pat. No. 3,798,879 to Schmidt-Burbach et al.; U.S. Pat. No. 3,910,778 to Shahgholi et al.; U.S. Pat. No. 5,199,257 to Colletta et al.; U.K. Patent No. 2,229,117 to Colletta; German Patent No. 4410213 to Kogleschatz; and German Patent No. 4400827 to Pechmann. In each of these systems, the air flow through the precipitator is generated by conventional means, and the electric field within the precipitator is generally perpendicular to the direction of flow; consequently, the ionizing action of the precipitator and the shape and orientation of the electric field are not suitable for causing or increasing air flow.

Electric fields have been used in conjunction with magnetic fields in ion pumps to form a vacuum by ionizing air molecules and causing the ions to colloid with and be buried within a cathode material. For example, U.S. Pat. No. 4,631,002 to Pierini discloses an ion pump comprising hollow anode elements formed between two cathode plates disposed between opposite poles of a magnet. Other patents disclosing ion pumps include U.S. Pat. No. 4,687,417 to Amboss and U.S. Pat. No. 3,452,923 to Lamont. While such pumps ionize air molecules, they are designed to trap such molecules and thus cannot generate an air flow.

Electric fields have also been used in electron beam generators and accelerators to accelerate electrons. For example, U.S. Pat. No. 5,463,268 to Schroeder discloses an electron accelerator which employs a negatively-charged electrode within an acceleration tube and conductive rings to accelerate electrons to a high velocity. U.S. Pat. No. 3,431,455 to Beyer discloses an electron imaging device which directs a beam of electrons onto a surface to form a charge pattern. Such devices typically operate in a vacuum and are not suitable for ionizing and accelerating air molecules or generating an air flow.

While the above patents establish that electric fields have been used to ionize air molecules and particles and to accelerate electrons, electric fields have not been exploited in the generation of an air flow, such as that produced by conventional impeller fans. In particular, it has not been demonstrated that a significant volume of air can be moved through a chamber from an air inlet to an air outlet by applying an electrostatic field to the air within the chamber. Further, conventional electrostatic precipitators used in ventilation systems do not enhance or increase air flow. Thus, fans that employ an electric field as a means of moving air are unknown.

SUMMARY OF THE INVENTION

It is an object of the present invention to produce an air flow using a fan assembly having no moving parts.

It is another object of the present invention to produce an air flow by applying an asymmetric electric field to a volume of air.

It is a further object of the present invention to provide a fan assembly that is virtually noiseless and free of vibrations while producing an air flow.

Another object of the present invention is to filter particles from an air stream flowing through a fan assembly.

Yet another object of the present invention is to ionize air molecules flowing through a fan assembly.

A further object of the present invention is to move air in a highly energy efficient manner.

The aforesaid objects are achieved individually and in combination, and it is not intended that the present invention be construed as requiring two or more of the objects to be combined unless expressly required by the claims attached hereto.

According to the present invention, air is moved, ionized and filtered by means of an electric field within a fan assembly having no moving parts. The system includes a tubular housing which draws air in through a flared inlet end and exhausts filtered air through an outlet end. Within the housing is a needle electrode which extends longitudinally. A net electrode is disposed within the housing on the outlet side of the needle electrode and extends in a transverse direction. The net electrode can be planar or curved to present a concave surface to the needle electrode. An electric potential on the order of tens of thousands of volts is applied between the needle and net electrodes to form an electric field therebetween. The combination of the longitudinally oriented needle electrode and the transversely oriented net electrode and their relative arrangement creates an electric field that is asymmetric in the longitudinal direction and that tends to ionize and accelerate air molecules toward the net electrode, carrying the air molecules past the net electrode and through the air outlet.

The voltage applied across the electrodes is a function of the space between the electrodes and is sufficient to produce a corona effect which ionizes air molecules in the field without causing discharge in the air or arcing between the electrodes. The spacing between the electrodes must be small enough to form an electric field of sufficient strength to ionize air molecules in a concentration sufficient to produce a significant air flow. However, the distance between the electrodes must be large enough that the ions generated are predominantly negative (in the case where the net electrode is positively charged), such that a large majority of the ions will be attracted to and accelerate toward the net electrode.

The overall length of the housing, the distance between the inlet end and the electrodes, and the distance between the electrodes are generally proportional to (i.e., scale with) a transverse linear dimension (e.g., the diameter) of the housing.

The system further includes a tubular duct electrode disposed within the housing on the outlet side of the net electrode, which collects ionized particles precipitated from the air. A conducting pivot, which is electrically connected to the net electrode, extends coaxially with the tubular duct electrode along at least a portion of the tubular duct electrode in the longitudinal direction and facilitates precipitation ofthe particles. The duct electrode can be removed and cleaned or replaced.

The system of the present invention can be used to provide air filtration, ionization and ventilation for enclosed spaces, on the order oftens of cubic meters, in which acoustical disturbances are not desirable, such as in transport cabins, harvesting and lifting machines, office buildings and factories, industrial exhaust systems, and in residential applications.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

The disclosures of all of the above patents are incorporated herein by reference in their entirety.

DESCRIPTION OF THE PREFERRED EMBODIMENTS

Figure 1:
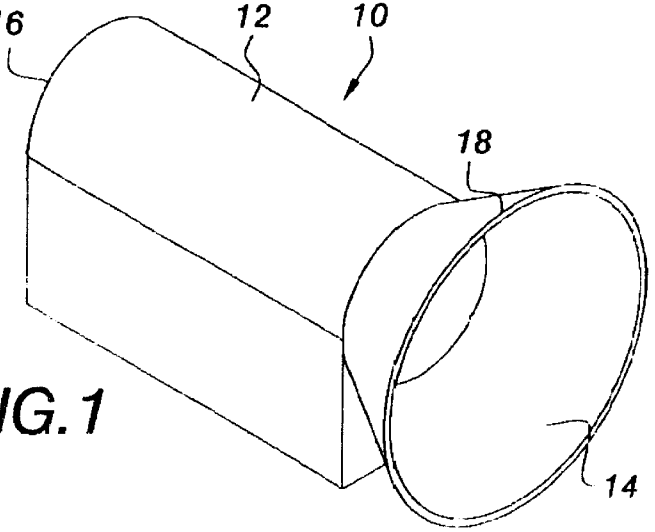
FIG. 1 is a perspective view of a system for moving and filtering air according to an exemplary embodiment of the present invention.
Figure 2:
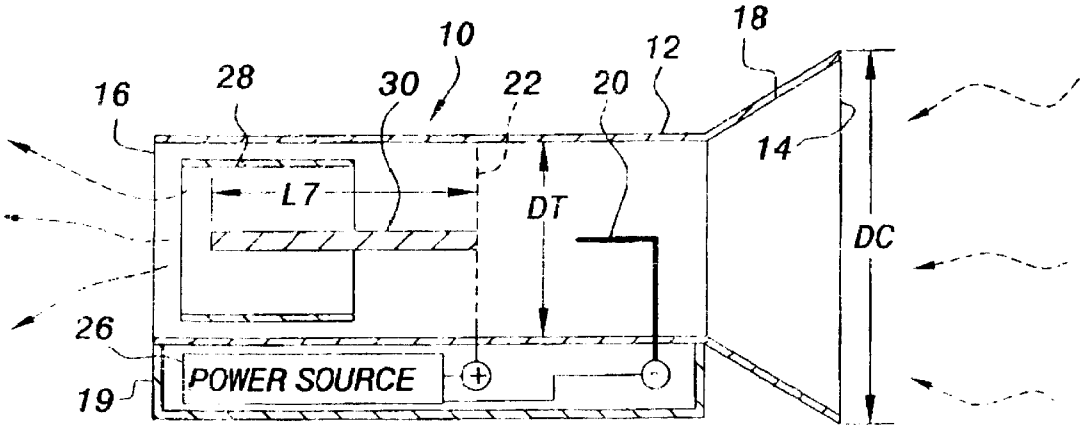
FIG. 2 is a side view in cross-section of the system shown in FIG. 1 with a flat net electrode.

A perspective view and a side sectional view of an assembly 10 for moving and filtering air according to an exemplary embodiment of the present invention are respectively illustrated in FIGS. 1 and 2. Assembly 10 includes a hollow, elongated, tubular housing 12 through which air flows from an open inlet 14 to an open outlet 16. Inlet 14 and outlet 16 may be covered by a protective mesh, grid or the like. In this context, the term "tubular" does not imply any particular cross-sectional shape. Tubular housing 12 can be formed from any conventional non-conducting material including, but not limited to, a polymer. In the exemplary embodiment, tubular housing 12 has a substantially circular cross-section perpendicular to the longitudinal direction (i.e., the direction of air flow), with the inlet end comprising a confuser 18 which flares toward inlet 14 to improve the air flow dynamics of air flowing into tubular housing 12. Between confuser 18 and outlet 16, tubular housing 12 is substantially cylindrical (i.e., with a substantially constant inner diameter).

While assembly 10 of the exemplary embodiment is shown with a circular cross-section and a cylindrical shape, the tubular housing may have other cross-sectional shapes which provide acceptable air flow, and the exemplary embodiment is not to be construed as limiting the invention to only substantially circular cross-sections or cylindrical shapes. For example, tubular housing 12 can have a cross-sectional shape that is elliptical, rectangular, square, polygonal, etc.

The cross-sectional dimensions of housing 12 are principal parameters in determining the air flow volume through housing 12, and most of the important dimensions of assembly 10 are proportional to (i.e., scale with) the cross-sectional dimensions of housing 12. Accordingly, most dimensions and distances relating to cylindrical housing 12 of the exemplary embodiment are described with respect to the inner diameter $D_T$ of the tubular portion of housing 12. More generally, it will be understood that these dimensions and distances are proportional to an inner, linear, cross-sectional dimension of the housing, where the cross-sectional shape of the housing can be other than circular. In the exemplary embodiment, the overall length $L_H$ of housing 12 in the longitudinal direction, inclusive of confuser 18, is preferably in the range between 2.5 to 4 times the inner diameter $D_T$ of the tubular portion of housing 12, and is more preferably approximately 3 times the diameter $D_T$.

For convenience, assembly 10 is shown in the figures as a stand-alone unit having a base 19 with a flat bottom for resting on a flat surface, such as a table top or floor. It will be understood, however, that the system of the present invention need not be a stand-alone unit. For example, the system can be integrated directly into a ventilation or air filtration system, such as within a duct of such a system.

Confuser 18 reduces the aerodynamic resistance of the air being drawn into housing 12 through inlet 14 and increases the air flow rate and the length of the air jet exhausted from outlet 16. It has been experimentally determined that the volume and rate of air flow through housing 12 is very sensitive to the geometry of confuser 18, and ajudiciously selected confuser geometry can increase the exit velocity of air from outlet 16 by 20% to 30% relative to a non-confuser (i.e., non-flared) configuration. The inner diameter $D_c$ of confuser 18 at inlet 14 (i.e., the maximum diameter of confuser 18) is preferably in the range between 1.0 and 1.5 times the inner diameter $D_T$ of confuser 18 at its inward longitudinal end (i.e., the inner diameter ofthe tubular portion of housing 12 and the minimum confuser diameter), and more preferably between 1.2 and 1.4 times the inner diameter $D_T$ of the tubular portion of housing 12. More generally (for all cross-sectional shapes), the cross-sectional area an inlet 14 is preferably in the range between 1.4 to 2.0 times the cross-sectional area at the inward end of confuser 18. The length $L_1$ of confuser 18 in the longitudinal direction is preferably in the range between 0.1 and 0.5 times the inner diameter $D_T$ of the tubular portion of housing 12, and more preferably in the range between 0.1 and 0.25 times the inner diameter $D_T$ (or a linear cross-sectional dimension, for non-circular cross-sections).

An electrically conductive needle electrode 20, in the shape of a wire or a thin rod, is disposed within housing 12 inward of confuser 18. More specifically, needle electrode 20 includes a transverse portion which extends radially from housing 12 to a central longitudinal axis therein, and a longitudinal portion which is bent at approximately 90° with respect to the transverse portion. The longitudinal portion of needle electrode 20 lies along the longitudinal axis and extends inward of the transverse portion, terminating at a pointed tip. Needle electrode 20 is electrically isolated from housing 12. The distance $L_2$ from the tip of needle electrode 20 to inlet 14 is preferably in the range between 0.7 and 1.5 times the inner diameter $D_T$, and more preferably in the range between 1.0 and 1.5 times $D_T$. While the needle electrode of the exemplary embodiment lies along the longitudinal axis, it will be understood that the needle electrode of the present invention need not lie directly along the axis or extend strictly parallel thereto. As used herein the terms "longitudinal direction" and "extending longitudinally" require an orientation generally extending along the path between inlet 14 and outlet 16, but do not require an orientation strictly parallel to the longitudinal axis of housing 12.

An electrically conductive net or mesh electrode 22 is disposed within housing 12 at a distance $L_3$ from inlet 14 that is greater than the distance $L_2$ from the tip of needle electrode 20 to inlet 14. Net electrode 22 extends transversely across substantially all of the interior cross-sectional area of housing 12. In the embodiment shown in FIG. 2, net electrode 22 has a substantially flat or planar disc shape with a diameter that is slightly less than the inner diameter $D_T$ of housing 12. Net electrode 22 is electrically isolated from housing 12. The distance $L_3$ is preferably in the range between 1.3 and 2 times the inner diameter $D_T$.

Figure 3:
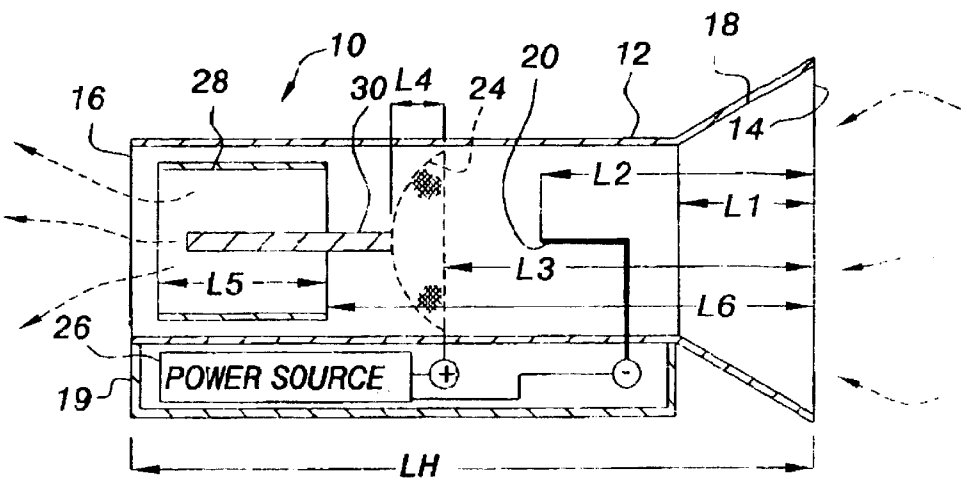
FIG. 3 is a side view in cross-section of the system shown in FIG. 1 with a curved net electrode.

According to another embodiment shown in FIG. 3, a net electrode 24 is curved. For example, net electrode is in the shape of a portion of a sphere or an ellipsoid. Specifically, net electrode 24 presents a concave surface to needle electrode 22, with the center of net electrode 24 projecting toward outlet 16 and being displaced from the peripheral edge of net electrode 24 in the longitudinal direction by a distance $L_4$. The distance $L_4$ is preferably in the range between 0.1 and 0.4 times the inner diameter $D_T$ of housing 12, and more preferably in the range between 0.1 and 0.3 times the inner diameter $D_T$ of housing 12. For a spherical net electrode, the radius of curvature $\rho$ is preferably in the range between 0.3 and 0.8 times the inner diameter $D_T$ of housing 12, and more preferably in the range between 0.6 and 0.8 times diameter $D_T$. It should be noted that, in the case of the curved net eletrode 24, the distance $L_3$ is measured from inlet 14 to the transverse plane in which the peripheral edge of net electrode 24 lies (i.e., the shortest distance between net electrode 24 and the inlet plane).

A negative terminal of a power supply 26 is electrically connected to needle electrode 20, and a positive terminal of power supply 26 is electrically connected to net electrode 22 (or 24). Power supply 26 comprises a transformer system, which may include several transformer stages, that steps up a voltage from an external power source to a high voltage required by assembly 10. In general, the potential difference between needle electrode 20 and net electrode 22 (or 24) is maintained at a level producing a field strength below a field strength at which discharge in the air takes place (approximately 35 kV/cm), e.g., approximately ¾ ths of this value. Thus, the potential difference between the electrodes is a function of the distance between the electrodes, and the distance between the electrodes is determined by the potential difference U therebetween and the electrode geometries. In accordance with the present invention, the mean electric field strength E is preferably in the range between 5 to 35 kV/cm, and the distance L between the electrodes is generally proportional to U/E. The optimal magnitude of the electric field E is determined as function of a number of parameters, including the electrode geometry and air humidity. For example, where the electrodes are separated by several centimeters, a potential difference between needle electrode 20 and net electrode 22 (or 24) in the range between 15 kV and 35 kV can be formed by application of the negative and positive terminals of power supply 26 to electrodes 20 and 22 (or 24), respectively.

As shown in FIGS. 2 and 3, where assembly 10 is a stand-alone unit, power source 26 can be contained within base 19, with electrodes 20 and 22 (or 24) extending through housing 12 into base 19 to electrically connect with power source 26. The power consumption of assembly 10 is comparable to that of a conventional fan producing a similar flow volume and rate and is on the order of 10 Watts for an air flow rate of approximately 3 to 4 m/s and a flow volume of approximately 0.35 to 0.47 cubic meters/minute.

In operation, the electric potential between negative needle electrode 20 and positive electrode 22 (or 24) forms an electric field of sufficient strength to ionize air molecules (e.g., $O_2$, $N_2$, $H_2O$) entering housing 12 though inlet 14. The concentration of air ions is on the order of at least 100 per $cm^3$. Due to the longitudinal asymmetry of the electric field formed by longitudinally oriented needle electrode 20 and transversely oriented net electrode 22 (or 24), negatively charged air ions tend to accelerate toward positively charged net electrode 22 (or 24) and pass through housing 12 and exit at outlet 16, thereby producing an electronic wind. More particularly, the flow of the negatively charged ions causes a concurrent flow of neutral air molecules through housing 12.

In order to produce a significant air flow, it is necessary to have a predomination of negatively charged air ions over positively charged air ions. The relative position of electrodes 20 and 22 (or 24) determines the strength and shape of the electric field and the energy of ionization. When the relative distance between electrodes 20 and 22 (or 24) is too great, the concentration of generated air ions is insufficient to produce significant air flow. When the relative distance between the electrodes is too small, the concentration of air ions is high, but the predomination of negative air ions over positive air ions is insufficient. It has been determined by the present inventors that, at the spacing given above, there is sufficient ionization (air ion concentration) and the necessary predomination of negative air ions to produce a significant electronic wind. By comparison, planar net electrode 22 provides a greater outlet air jet length than curved net eletrode 24, while curved net electrode 24 provides more uniform ionization than planar net electrode 22. The overall length L of housing 12 affects the length of the air flow jet at outlet 16 as is determined by the spacing between electrodes 20 and 22 (or 24).

Needle electrode 20 emits charged particles (electrons). The electrons move to the net electrode 22 (or 24) and ionize the air molecules in this region, forming a mixture of positive and negative ions and free electrons. Slow moving ions are neutralized on the net electrode 22 (or 24).

A portion of the electrons is also neutralized; however, some electrons having a high speed slip past the net electrode 22 (or 24). The energy of these electrons is not enough to ionize the air molecules by the blow. That is why they give part of their energy to the air molecules carrying them away but are themselves slowed down. The slow electrons stick to the oxygen molecules, forming negative ions.

As shown in FIGS. 2 and 3, a cylindrical duct electrode 28, having an outer diameter that is less than the inner diameter $D_T$ of housing 12, is concentrically arranged within housing 12 on an outlet side of net electrode 22 (or 24). Duct electrode 28 attracts and collects ionized particles, such as dust and particulate matter in the air flow passing through housing 12. Duct electrode 28 can be a metallic cylinder or a metallic cylinder with a thin, removable porous cover. Duct cathode 28 is preferably grounded for electro-safety reasons. The length $L_5$ of duct electrode 28 in the longitudinal direction is preferably in the range between 0.3 and 0.5 times the length $L_H$ of housing 12. The distance $L_6$ from inlet 14 to the near end of duct electrode 28 (i.e., the longitudinal end further from outlet 16) is preferably in the range between 2 and 2.5 times the inner diameter $D_T$ of housing 12.

Duct electrode 28 can be removed from housing 12 to dispose of particles collected thereon. For example, housing 12 can be opened at outlet 16 for removal of duct electrode 28. Alternatively, housing 12 can be formed of two cylindrical segments which are detachably joined in the vicinity of duct electrode 28 and which can be separated to remove duct electrode 28 for cleaning or replacement. In the case where duct electrode 28 includes a porous cover for collecting particles, the porous cover can be removed from the metallic cylinder for cleaning or replacement with a new cover.

An electrically conductive pivot 30 in the shape of a wire or thin rod, and electrically connected to the net electrode 22 (or 24), extends along the longitudinal center axis of housing 12 from the surface of net electrode 22 (or 24) toward outlet 16. Specifically, conducting pivot 30 extends coaxially through the center of the space surrounded by duct electrode 28 and terminates within duct electrode 28 toward the outlet end thereof. The length $L_7$ of pivot 30 is preferably in the range between 1.0 and 1.1 times the inner diameter $D_T$ of housing 12 and more preferably approximately 1.05 times $D_T$, When power is applied to electrodes 20 and 22 (or 24), pivot 30 is at the same potential as electrode 22 (or 24).

Pivot 30 promotes precipitation of particles onto the walls of duct electrode 28. More specifically, pivot 30 is connected to positively charged net electrode 22 (or 24); thus, a radial electric field is formed between pivot 30 and duct electrode 28 which is held at a lower potential (ground). In this configuration, pivot 30 serves as an anode and duct electrode 28 serves as a cathode, causing positively charged particles to move toward and adhere to duct electrode 28 due to the radial electric field. The particles adhere to duct electrode 28 and lose their electric charge so that duct electrode 28 operates as a dust particle collector. Pivot 30 need not be a wire or thin rod and can have other longitudinally extending aerodynamic shapes, including, but not limited to, a cylinder.

In certain applications, such as those within the microelectronic industry and in the field of processing micropatterns (e.g., in clean rooms), it is desirable to filter particles from an air stream while generating a relatively small air flow volume with a minimum of air turbulence. For such applications, it is desirable to apply the positive terminal of power supply 26 to needle electrode 20 and the negative terminal of power supply 26 to the net electrode 22 (or 24). This arrangement still causes air to flow through housing 12 from inlet 14 to outlet 16 due to the asymmetric electric field, and results in filtration of dust particles and the like comparable to that achieved in the negative ionization system. However, because the mass of the positively charged ions is greater than that of negatively charged ions, the positive ions exiting housing 12 have less kinetic energy and produce less air flow volume and velocity.

By way of a non-limiting example, assembly 10 shown in the figures can have the following parameters:

| | |
|---|---|
| Inner Diameter $D_T$ of Housing 12 | 50 mm |
| Inner Diameter $D_C$ of Confuser 18 at Inlet Opening | 75 mm |
| Longitudinal Length $L_H$ of housing 12, Including Confuser 18 | 150 mm |
| Longitudinal Length $L_1$ of Confuser | 20 mm |
| Distance $L_2$ from Confuser Inlet 14 to Tip of Needle Electrode 20 | 50 mm |
| Distance $L_3$ from Confuser Inlet 14 to Flat Net Electrode 22 | 65 mm |
| Radius of Curvature ρ of Spherical Net 24 | 32.5 mm |
| Maximum Longitudinal Displacement L4 of Spherical Net 24 | 10 mm |
| Longitudinal Length $L_5$ of Duct Electrode | 50 mm |
| Distance $L_6$ from Confuser Inlet 14 to Duct Electrode 28 | 100 mm |
| Longitudinal Length $L_7$ of Pivot 30 | 52.5 mm |
| Electric Field Strength U | 22 kV |
| Power Consumption P | 10 W |
| Air Flow Volume V | 376.8 dm 3/min (=13.3 ft 3/min) |
| Air Flow Rate v | 3.2 m/s |

It is to be understood that these dimensions and parameters are provided by way of example only and are not in any way limiting on the scope of the invention.

The apparatus for moving, filtering and ionizing air described herein can serve as an elementary cell in an array of cells arranged to move parallel columns of air. More specifically, multiple cells can be positioned side-by-side with their respective longitudinal axes aligned substantially in parallel, such that the cells move air in substantially the same direction. By way of non-limiting example, an array of apparatuses can be arranged side-by-side to form a panel having a cross-section of 1×1 square meter in the transverse direction (perpendicular to the direction of air flow) and 20 cm in the longitudinal direction (the direction of air flow). Each cell can have a distinct tubular housing abutted against adjacent cells, or adjacent cells can share common longitudinal housing sections, with individual cells having a square, rectangular or hexagonal cross-section. Such an array could function as a noiseless ceiling fan to ventilate a room.

The system of the present invention can be used to provide air filtration, ventilation and ionization for enclosed spaces, on the order of tens of cubic meters, in which acoustical disturbances are not desirable, such as in transport cabins, harvesting and lifting machines, office buildings and factories, industrial exhaust systems, and in residential applications. The system power requirements are comparable to those of a conventional fan producing the same air flow rate and volume. For example, the exemplary system having the above parameters produced an air flow of approximately 13.3 cubic feet/minute using approximately 10 Watts of power.

While the system described in the exemplary embodiment includes a single needle electrode, more than one needle electrode can be used. For example, two adjacent needle electrodes terminating at the same distance from the inlet can be used to increase the output of the system. Thus, the "needle electrode" can comprise a plurality of needle electrode elements.

Having described preferred embodiments of a new and improved method and apparatus for moving ionized air, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. An apparatus for moving air, comprising:

a housing having a tubular potion, an inlet end adapted to receive air and an outlet end adapted to exhaust air;

a needle electrode disposed with said housing and extending in a longitudinal direction;

a net electrode disposed within said housing on an outlet side of said needle electrode and extending in a transverse direction; and a power supply coupled to said needle electrode and to said net electrode and configured to apply a potential difference between said needle electrode and said net electrode to form a longitudinally asymmetric electric field capable of ionizing air molecules and accelerating air molecules toward the outlet end of the housing, thereby producing an air flow from the inlet end to the outlet end of said housing, wherein:

a distance $L_2$ from the inlet end to a tip of said needle electrode is in the range between 0.7 and 1.5 times an interior transverse linear dimension $D_T$ of the tubular portion of said housing;

a distance $L_3$ from the inlet end to a closest surface of said net electrode is in the range between 1.3 and 2.0 times said dimension $D_T$; and a length $L_H$ of said housing in the longitudinal direction is in the range between 2.5 and 4 times said dimension $D_T$.

2. The apparatus according to claim 1, wherein the tubular portion of said housing is cylindrical and said dimension $D_T$ is an interior diameter of the tubular portion.

3. The apparatus according to claim 1, wherein:

said distance $L_2$ is in the range between 1.0 and 1.5 times said dimension $D_T$; and said length $L_H$ is approximately 3 times said dimension $D_T$.

4. The apparatus according to claim 1, wherein said power supply applies a negative potential to said needle electrode and a positive potential to said net electrode.

5. The apparatus according to claim 1, wherein said power supply applies a positive potential to said needle electrode and a negative potential to said net electrode.

6. The apparatus according to claim 1, wherein said net electrode is substantially planar.

7. The apparatus according to claim 1, wherein said housing further includes a flared confuser terminating at the inlet end.

8. The apparatus according to claim 1, further comprising:

a tubular duct electrode disposed within said housing on the outlet side of said net electrode, said tubular duct electrode collecting particles precipitated from the air; and a conducting pivot electrically connected to said net electrode and extending coaxially with said tubular duct electrode along at least a portion of said tubular duct electrode in the longitudinal direction, said conducting pivot facilitating precipitation of said particles.

9. The apparatus according to claim 1, wherein said needle electrode comprises a plurality of longitudinally extending needle electrode elements.

10. An apparatus for moving air, comprising:

a housing having a tubular portion, an inlet end adapted to receive air and an outlet end adapted to exhaust air;

a needle electrode disposed with said housing and extending in a longitudinal direction;

a net electrode disposed within said housing on an outlet side of said needle electrode and extending in a transverse direction; and a power supply coupled to said needle electrode and to said net electrode and configured to apply a potential difference between said needle electrode and said net electrode to form a longitudinally asymmetric electric field capable of ionizing air molecules and accelerating air molecules toward the outlet end of the housing, thereby producing an air flow from the inlet end to the outlet end of said housing, wherein said net electrode is curved and presents a concave surface to said needle electrode.

11. The apparatus according to claim 10 wherein:

said net electrode is in the shape of a portion of a sphere and a radius of curvature $\rho$ of said net electrode is not less than 0.3 times an interior transverse linear dimension $D_T$ of the tubular portion of said housing; and said net electrode extends in the longitudinal direction a distance $L_4$ in the range between 0 and 0.4 times said dimension $D_T$.

12. The apparatus according to claim 11, wherein the tubular portion of said housing is cylindrical and said dimension $D_T$ is an interior diameter of the tubular portion.

13. The apparatus according to claim 11, wherein:

said radius of curvature $\rho$ is in the range between 0.6 and 0.8 times said dimension $D_T$; and said distance $L_4$ in the range between 0.1 and 0.3 times said dimension $D_T$.

14. The apparatus according to claim 10, wherein said power supply applies a negative potential to said needle electrode and a positive potential to said net electrode.

15. The apparatus according to claim 10, wherein said power supply applies a positive potential to said needle electrode and a negative potential to said net electrode.

16. The apparatus according to claim 10, wherein said needle electrode comprises a plurality of longitudinally extending needle electrode elements.

17. An apparatus for moving air, comprising:

a housing having a tubular portion, an inlet end adapted to receive air and an outlet end adapted to exhaust air;

a needle electrode disposed with said housing and extending in a longitudinal direction;

a net electrode disposed within said housing on an outlet side of said needle electrode and extending in a transverse direction; and a power supply coupled to said needle electrode and to said net electrode and configured to apply a potential difference between said needle electrode and said net electrode to form a longitudinally asymmetric electric field capable of ionizing air molecules and accelerating air molecules toward the outlet end of the housing, thereby producing an air flow from the inlet end to the outlet end of said housing, wherein:

said housing further includes a flared confuser terminating at the inlet end;

an interior transverse linear dimension $D_C$ of said confuser at the inlet end is in the range between 1.0 and 1.5 times an interior transverse linear dimension $D_T$ of the tubular portion of said housing; and a length $L_1$ of said conflser in the longitudinal direction is in the range between 0.1 and 0.5 times said dimension $D_T$.

18. The apparatus according to claim 17, wherein the tubular portion of said housing is cylindrical and said dimension $D_T$ is an interior diameter of the tubular portion.

19. The apparatus according to claim 17, wherein:

the dimension $D_C$ is in the range between 1.2 and 1.4 times said dimension $D_T$; and the length $L_1$ is in the range between 0.1 and 0.25 times said dimension $D_T$.

20. The apparatus according to claim 17, wherein said power supply applies a negative potential to said needle electrode and a positive potential to said net electrode.

21. The apparatus according to claim 17, wherein said power supply applies a positive potential to said needle electrode and a negative potential to said net electrode.

22. The apparatus according to claim 17, wherein said needle electrode comprises a plurality of longitudinally extending needle electrode elements.

23. An apparatus for moving air, comprising:

a housing having a tubular portion, an inlet end adopted to receive air and an outlet end adapted to exhaust air;

a needle electrode disposed with said housing and extending in a longitudinal direction;

a net electrode disposed within said housing on an outlet side of said needle electrode and extending in a transverse direction;

a power supply coupled to said needle electrode and to said net electrode and configured to apply a potential difference between said needle electrode and said net electrode to form a longitudinally asymmetric electric field capable of ionizing air molecules and accelerating air molecules toward the outlet end of the housing, thereby producing an air flow from the inlet end to the outlet end of said housing, a tubular duct electrode disposed within said housing on the outlet side of said net electrode, said tubular duct electrode collecting particles precipitated from the air; and a conducting pivot electrically connected to said net electrode and extending coaxially with said tubular duct electrode along at least a portion of said tubular duct electrode in the longitudinal direction, said conducting pivot facilitating precipitation of said particles, wherein:

a length $L_5$ of said duct electrode in the longitudinal direction is in the range between 0.3 and 0.5 times an interior transverse linear dimension $D_T$ of the tubular portion of said housing;

a distance $L_6$ from the inlet end to a nearest point on said duct electrode is in the range between 2 and 2.5 times said dimension $D_T$; and a length $L_7$ of said pivot in the longitudinal direction is in the range between 1.0 and 1.1 times said dimension $D_T$.

24. The apparatus according to claim 23, wherein the tubular portion of said housing is cylindrical and said dimension $D_T$ is an interior diameter of the tubular portion.

25. The apparatus according to claim 23, wherein said duct electrode is removable.

26. The apparatus according to claim 23, wherein said power supply applies a negative potential to said needle electrode and a positive potential to said net electrode.

27. The apparatus according to claim 23, wherein said power supply applies a positive potential to said needle electrode and a negative potential to said net electrode.

28. The apparatus according to claim 23, wherein said needle electrode comprises a plurality of longitudinally extending needle electrode elements.

29. A method of moving air, comprising the steps of:

a) providing a tubular housing having an inlet end for receiving air and an outlet end for exhausting air;

b) extending a needle electrode in a longitudinal direction within the tubular housing, such that a distance $L_2$ from the inlet end to a tip of said needle electrode is in the range between 0.7 and 1.5 times an interior transverse linear dimension $D_T$ of the tubular portion of said housing;

c) mounting a net electrode within the tubular housing in a transverse direction on an outlet side of the needle electrode, such that a distance $L_3$ from the inlet end to a closest surface of said net electrode is in the range between 1.3 and 2.0 times said dimension $D_T$;

d) applying an electric potential between the needle electrode and the net electrode to form a longitudinally asymmetric electric field capable of ionizing air molecules and accelerating air molecules toward the outlet end of the housing, thereby producing an air flow from the inlet end to the outlet end of the housing.

30. The method according to claim 29, wherein step c) includes mounting a substantially planar net electrode.

31. The method according to claim 29, wherein step a) includes forming the housing to be flared at the inlet end.

32. The method according to claim 29, further comprising the steps of:

e) disposing a tubular duct electrode within the housing on the outlet side ofthe net electrode;

f) extending a conducting pivot, electrically connected to the net electrode, coaxially with the tubular duct electrode along at least a portion of the tubular duct electrode in the longitudinal direction;

g) using the tubular duct electrode and the conducting pivot to precipitate ionized particles from the air; and h) collecting the precipitated particles on the tubular duct electrode.

33. A method of moving air, comprising the steps of:

a) provident a tubular housing having an inlet end for receiving air and an outlet end for exhausting, air;

b) extending a needle electrode in a longitudinal direction within the tubular housing;

c) mounting a curved net electrode, which presents a concave surface to the needle electrode, within the tubular housing in a transverse direction on an outlet side of the needle electrode;

d) applying an electric potential between the needle electrode and the net electrode to form a longitudinally asymmetric electric field capable of ionizing air molecules and accelerating air molecules toward the outlet end of the housing, thereby producing an air flow from the inlet end to the outlet end of the housing.

34. An apparatus for moving air, comprising:

an array of air-moving cells, each of said cells including: a longitudinally-extending tubular housing having an inlet end adapted to receive air and an outlet end adapted to exhaust air; a needle electrode disposed with said housing and extending in a longitudinal direction; a net electrode disposed within said housing on an outlet side of said needle electrode and extending in a transverse direction; and a power supply coupled to said needle electrode of each of said cells and to said net electrode of each of said cells and configured to apply a potential difference between said needle electrode and said net electrode to form a longitudinally asymmetric electric field capable of ionizing air molecules and accelerating air molecules toward the outlet end of said housing of each of said cells, thereby producing an air flow from the inlet end to the outlet end of said housing of each of said cells; said cells being arranged such that said cells produce an air flow in substantially a same direction.

35. The apparatus according to claim 34, wherein adjacent cells in said array of cells share a common boundary serving as a portion of the tubular housing of the adjacent cells.

36. The apparatus according to claim 35, wherein the tubular housing of each of said cells has a rectangular or square transverse cross-section.

37. The apparatus according to claim 35, wherein the tubular housing of each of said cells has a hexagonal transverse cross-section.

* * * * *